US006352606B1

(12) United States Patent
DiMarco et al.

(10) Patent No.: US 6,352,606 B1
(45) Date of Patent: Mar. 5, 2002

(54) CONSUMER ARTICLE SECURITY ARRANGEMENT

(75) Inventors: Gerald DiMarco, Poughkeepsie, NY (US); Richard Gursky, Sr., Oakville, CT (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/354,455

(22) Filed: Jul. 15, 1999

(51) Int. Cl.[7] ..... G08B 13/14

(52) U.S. Cl. ..... 156/212; 156/217; 156/291; 340/572.1; 340/572.9; 340/571; 340/568.8

(58) Field of Search ..... 340/572.1, 571, 340/568.1, 568.8; 156/217, 196, 212, 291, 572.9

(56) References Cited

U.S. PATENT DOCUMENTS

| | | | | |
|---|---|---|---|---|
| 2,096,352 A | * | 10/1937 | Semonsen | |
| 3,942,829 A | | 3/1976 | Humble et al. | 292/316 |
| 3,995,900 A | | 12/1976 | Humble et al. | 292/316 |
| 4,962,369 A | * | 10/1990 | Close | 340/572 |
| 5,524,463 A | * | 6/1996 | Schenkel et al. | 70/57.1 |
| 5,714,935 A | | 2/1998 | Ryan, Jr. | 340/572 |
| 5,969,613 A | * | 10/1999 | Yeager et al. | 340/572.9 |
| 5,984,388 A | * | 11/1999 | Bacon | 292/370 R |

* cited by examiner

*Primary Examiner*—Sam Chuan Yao
(74) *Attorney, Agent, or Firm*—Carmody & Torrance LLP

(57) ABSTRACT

Generally speaking, the present invention comprises a method for securing a timepiece to a display unit. The timepiece includes a head and a strap, and the display unit includes a member adapted to support the timepiece. The method includes the steps of: arranging the timepiece upon the member; affixing a security device to a securing means; and securing the securing means about the strap of the timepiece and a portion of the member, wherein the timepiece is secured to the member by the securing means. In one embodiment, the method includes the step of affixing the security device to the securing means by means of an adhesive. For example, the securing means is an adhesive layer having a center portion, a first side flap and a second side flap opposite the first side flap, and the method includes an initial step of tapering the ends of the first and second side flaps opposite the center portion. In another embodiment, the method for securing a timepiece to a display unit includes the steps of: arranging the timepiece upon the member; providing a securing means about the strap of the timepiece and a portion of the member, wherein the timepiece is secured to the member by the securing means; and providing a security device and securing the security device intermediate the member and the strap by the securing means.

5 Claims, 2 Drawing Sheets

CONSUMER ARTICLE SECURITY ARRANGEMENT

FIELD OF THE INVENTION

This invention relates generally to surveillance systems for protecting consumer articles from theft, and more particularly, to an improved methodology and construction for securing consumer articles such as electronic timepieces to a display unit and reducing the likelihood of theft thereof.

BACKGROUND OF THE INVENTION

It is well known to provide surveillance systems to prevent or to deter theft of merchandise from retail sales establishments. For example, well known systems for preventing the unauthorized removal of merchandise include providing scanners which establish an electromagnetic or magnetic field at entrances and exits of a retail sales establishment. Attached to the merchandise may be an electronic article surveillance (EAS) marker or tag that, when activated, interacts with the electromagnetic or magnetic field to indicate that tagged merchandise is entering the field. In this way, the presence of an active EAS marker activates an alarm indicating that merchandise containing an active EAS marker is being removed from the premises.

The foregoing systems have been somewhat successful in deterring theft of merchandise. However, certain merchandise such as, for example, consumer articles such as timepieces have heretofore not be able to be tagged with an EAS marker in a manner which ensures the ability to pick up and examine the timepiece while simultaneously reducing the likelihood of theft of the timepiece. For example, wristwatch type timepieces generally include a casing containing watch circuitry and a strap for securing the timepiece to the wrist of a user. As can be appreciated, the substantial value of the timepiece lies in the components contained within the casing. Presently, EAS markers may be either affixed to the straps of the timepiece or to the display boxes which contain the timepiece. Regrettably, the straps can be easily cut or the timepiece can be removed from the display box to effectively defeat the surveillance system. That is, the inability to reliably secure the watch to the display unit while simultaneously securing an EAS marker thereto illustrates the deficiency in the prior art.

Accordingly, the present invention provides an improved method and construction for securing a security device such as, for example, an EAS marker to a consumer article such as a wristwatch. In particular, the present invention provides a security arrangement for simultaneously fastening a security device to an electronic timepiece and display unit.

OBJECTS AND ADVANTAGES OF THE INVENTION

Therefore, it is an object and advantage of this invention to provide an improved method and arrangement for reducing or eliminating the theft of a consumer article, such as a timepiece.

Further objects and advantages of this invention will become more apparent from a consideration of the drawings and ensuing description.

SUMMARY OF THE INVENTION

The foregoing and other problems are overcome and the objects and advantages are realized by methods and apparatus in accordance with embodiments of this invention, wherein an improved security arrangement for fastening a security device to a consumer device such as a timepiece, is disclosed.

Generally speaking, the present invention comprises a method for securing a timepiece to a display unit. The timepiece includes a head and a strap, and the display unit includes a member adapted to support the timepiece. The method includes the steps of: arranging the timepiece upon the member; affixing a security device to a securing means; and securing the securing means about the strap of the timepiece and a portion of the member, wherein the timepiece is secured to the member by the securing means.

In one embodiment, the method includes the step of affixing the security device to the securing means by means of an adhesive. For example, the securing means is an adhesive layer having a center portion, a first side flap and a second side flap opposite the first side flap, and the method includes an initial step of tapering the ends of the first and second side flaps opposite the center portion.

In another embodiment, the method for securing a timepiece to a display unit includes the steps of: arranging the timepiece upon the member; providing a securing means about the strap of the timepiece and a portion of the member, wherein the timepiece is secured to the member by the securing means; and providing a security device and securing the security device intermediate the member and the strap by the securing means.

BRIEF DESCRIPTION OF THE DRAWINGS

The above set forth and other features of the invention are made more apparent in the ensuing Detailed Description of the Preferred Embodiments when read in conjunction with the attached Drawings, wherein.

Identically labeled elements appearing in different ones of the above-described figures refer to the same elements but may not be referenced in the description for all figures.

DETAILED DESCRIPTION OF THE PREFERRED EMBODIMENTS

Figure 1:
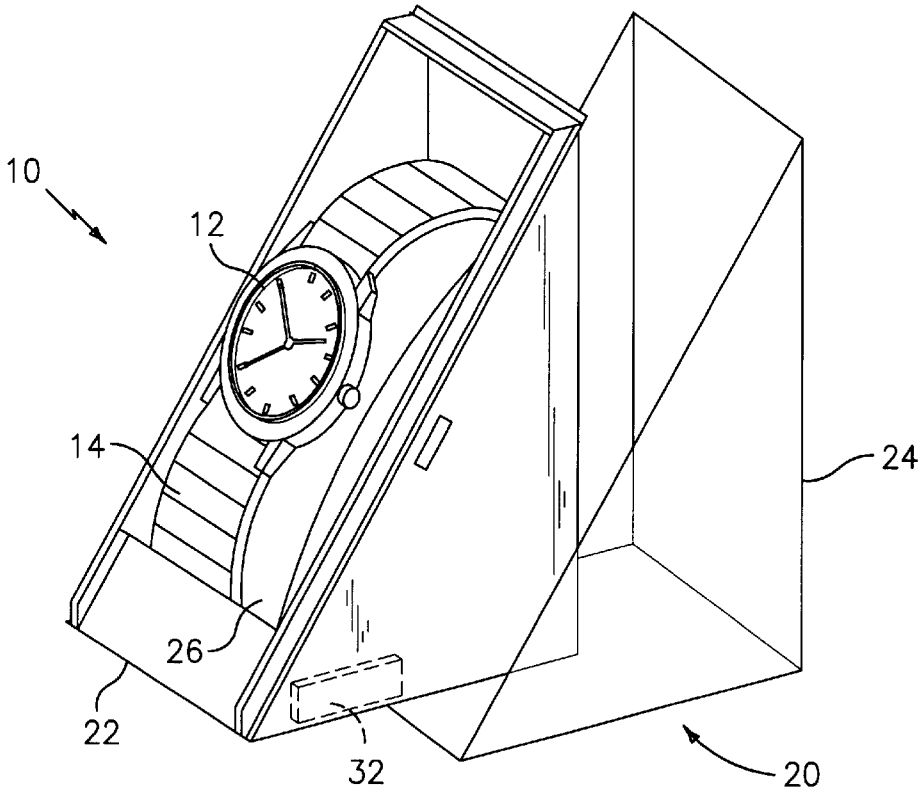
FIG. 1 (PRIOR ART)
FIG. 1 is a perspective view of a conventional display box adapted to hold a timepiece.

As shown in FIG. 1, a conventional display box 20 contains a consumer article such as, for example, a timepiece 10 having a watch case 12 and a strap 14 for securing the timepiece 10 to the wrist of a wearer. The display box 20 typically includes a front box half 22 and a rear box half 24 comprised of rigid plastic material to facilitate display of the timepiece 10 enclosed therein. The display box 20 also contains a member adapted to support the portable electronic device. For example, and as shown more clearly in FIG. 2, the display box 20 includes a C-clip. As is generally known, the C-clip includes a plastic molding of a flexible C-shaped member 26 secured to a base 28 by an integral rib 30. The timepiece 10 is mounted on the flexible C-shaped member 26 such that the strap 14 encircles the member 26. As a result, an examination the timepiece 10 may be achieved by sliding the strap 14 off the C-shaped member 26.

Figure 2:
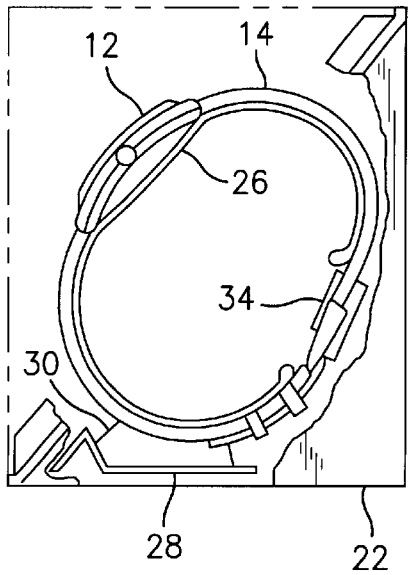
FIG. 2 (PRIOR ART)
FIG. 2 is a side elevational view in partial cross-sectional of the display box of FIG. 1.

While it may be desirable to permit an examination of the timepiece 10, it is also desirable to maintain traceability or surveillance of the timepiece 10 during the examination to minimize the risk of theft. In the past, retailers have placed electronic article surveillance (EAS) markers or tags 32 on or in product containers, for example, in the display box 20 shown in FIG. 1. Alternately, EAS tags have been affixed to the products themselves, for example, an EAS tag 34 having a pin for piercing a portion of a product and a hinged member which closes about the product locks the EAS tag 34 to the product, as shown in FIG. 2. As discussed in the Background Section of this application, and as is evidenced by U.S. Pat. No. : 3,995,900, issued Dec. 7, 1976, entitled "Reusable Security Tag", by Humble et al., security tags of this type are well known.

A perceived disadvantage of these conventional surveillance systems is seen to be the ease in which these systems may be defeated by removing the EAS marker from the product, such as by cutting strap 14 about the tag 34. Similarly, if the product container includes the EAS marker, these surveillance systems may be defeated by removing the product from the product container.

For example, in FIG. 1, if the timepiece 10 is removed from the display box 20, the EAS marker affixed within has effectively been defeated. That is, the timepiece 10 can pass through the magnetic field at the entrance to the store without purchasing the timepiece 10 and without triggering an alarm. Alternatively, the strap 14 of the timepiece 10 is affixed with an EAS marker 34. If the strap 14 of the timepiece 10 is cut, then the advantage of using the EAS marker 34 is again defeated and the substantial value of the timepiece 10 (i.e. the casing 12) can be carried through the magnetic field at the store entrance or exit without triggering the alarm.

Figure 3:
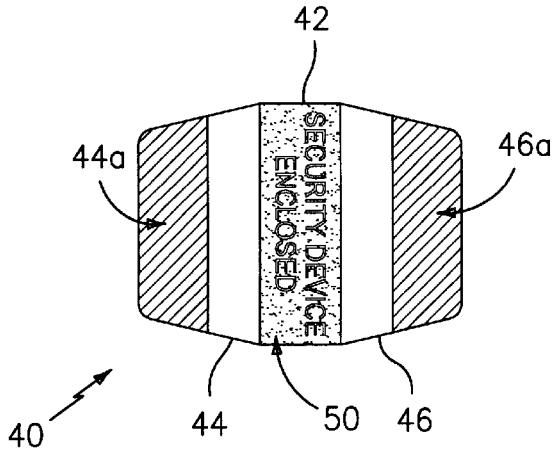
FIG. 3 is a top plan view of a security strap constructed in accordance with the present invention.

It is perceived that if the watch cannot be removed from the display unit, an improved security arrangement can be achieved. In accordance with the present invention, a security strap 40 or other suitable securing material is provided for affixing a security device to a consumer article such as timepiece in a product display unit. FIG. 3 illustrates one embodiment of the security strap 40 wherein the security strap 40 includes a center portion 42, a first side flap end 44 and a second side flap 46. The first end 44 and the second end 46 each extend outwardly from the center portion 42 and include an adhesive-coated area 44*a* and 46*a*, respectively. The adhesive-coated areas 44*a* and 46*a* facilitate attachment to one of the strap 14, the member 26 or unto itself as disclosed below.

Figure 4:
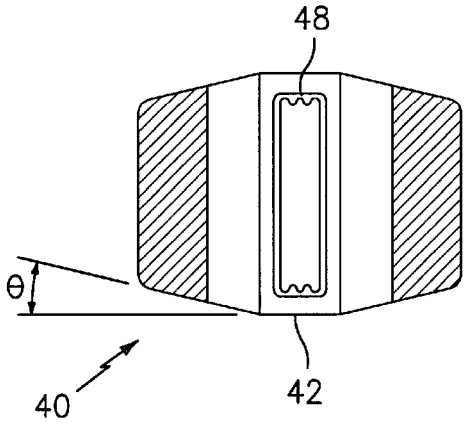
FIG. 4 is a rear plan view of the security strap of FIG. 3 which illustrates a preferred position of a security device.

As shown in FIGS. 3 and 4, the center portion 42 has a width that is suitable to preferably cover the security device 48. The first side flap 44 and the second side flap 46 have a width that is smaller than the width of the center portion 42 (i.e. tapered) to facilitate wrapping the security strap 40 around the timepiece 10 and a portion of member 26. That is, the flaps 44 and 46 have a tapered contour with a width that decreases as the ends 44 and 46 extend outwardly from the center portion 42. In FIG. 4 the tapered contour of the ends 44 and 46 is illustrated by an angle θ which, for example, may be about 13°.

Preferably, the security strap 40 is a polyolefin clear film of a thickness of about 2.5 mil, and the adhesive-coated areas 44*a* and 46*a* include a permanent gum adhesive. Preferably, the security strap 40 is comprised of tear resistant material. In FIG. 3 the center portion 42 also preferably includes a backing sheet 50 to conceal the presence of the security device from visual detection. In one embodiment, the backing sheet 50 may include indicia, which indicates that a security device is present. As should be appreciated, the backing sheet 50 may permit a selective use of security devices within the security strap 40. That is, not all merchandise within the inventory of a retail sales establishment need be tagged with a security device. By concealing the presence, or lack thereof, of a security device on each item in inventory the cost of EAS tagging each item may be reduced.

As shown in FIGS. 3 and 4, the center portion 42 has a width that is suitable to preferably cover the security device 48. The security device may be an electronic article surveillance (EAS) label 48 such as an ULTRASTRIP™ Label produced by the Sensormatic Electronic Corporation of Hollywood, Fla. As shown in FIG. 4, the EAS label 48 is placed within the center portion 42. In one embodiment, the EAS label 48 may be bonded or otherwise affixed by adhesive to the center portion 42 or, as discussed above, the EAS label 48 may be wrapped within the backing sheet 50 that is then bonded to the center portion 42.

Figure 5:
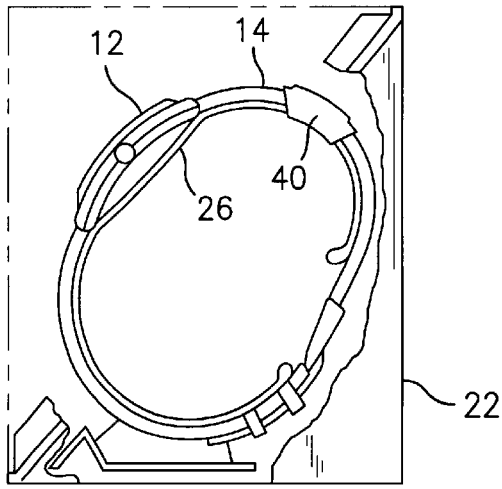
FIG. 5 is a side elevational view in partial cross-section of a display box wherein is illustrated the security strap of FIGS. 3 and 4 in engagement with a portion of the display unit and a timepiece strap.

In FIG. 5 the security strap 40 is shown is a preferred arrangement. That is, the security strap 40 encloses both the strap 14 of the timepiece 10 and a portion of the C-shaped member 26 of the display box 20. In this arrangement the timepiece 10 cannot be removed from the C-shaped member 26 without removal of the security strap and, most importantly, the security device (i.e. the EAS label 48) from the timepiece 10. It should be understood that flaps 44 and 46 may be positioned inside C-clip member 26, that is, so as to provide the strap 14 intermediate member 26 and device 48. Alternatively, the security device 48 may be positioned on the inside surface of member 26 such that member 26 is intermediate device 48 and strap 14. Lastly, the length of flaps 44 and 46 will determine whether they overlay one another or are merely affixed to the strap or C-clip. The actual securing of the flaps 44 and 46 to the strap, C-clip member or upon itself is achieved by the aforementioned coated areas 44*a* and 46*a*.

Although described in the context of preferred embodiments, it should be realized that a number of modifications to these teachings may occur to one skilled in the art. As should be appreciated, the scope of the present invention is not limited to wrapping the security strap 40 around portions of the strap 14 of the timepiece 10 and the C-shaped member 26. It is also contemplated that the security strap 40 may also be affixed to a surface of the watch casing 12 by means of the clear adhesive-coated areas 44*a* and 46*a*.

While the invention has been particularly shown and described with respect to preferred embodiments thereof, it will be understood by those skilled in the art that changes in form and details may be made therein without departing from the scope and spirit of the invention.

What is claimed is:

1. A method for securing a timepiece to a display unit, the timepiece comprising a head and a strap and the display unit comprising a supporting member adapted to support the timepiece, the method comprising the steps of:

arranging the timepiece upon the supporting member;

affixing a security device to a securing means; and securing the securing means about the strap of the timepiece and a portion of the supporting member, wherein the timepiece is secured to the supporting member by the securing means.

2. The method as set forth in claim 1, including the step of affixing the security device to the securing means by an adhesive.

3. The method as set forth in claim 2, wherein the securing means is an adhesive layer having a center portion, a first side flap and a second side flap opposite the first side flap, and wherein the method comprises the step of tapering the ends of the first and second side flaps opposite the center portion.

4. A method for securing a timepiece to a display unit, the timepiece comprising a head and a strap and the display unit comprising a supporting member adapted to support the timepiece, the method comprising the steps of:

arranging the timepiece upon the supporting member;

providing a securing means about the strap of the timepiece and a portion of the supporting member, wherein the timepiece is secured to the supporting member by the securing means; and providing a security device and securing the security device intermediate the supporting member and the strap by the securing means.

5. A timepiece and display unit arrangement, in which the timepiece comprises a head and a strap, and further in which the display unit comprises a supporting member adapted to support the timepiece, wherein the arrangement in which the timepiece is secured to the display unit is constructed by:

arranging the timepiece upon the supporting member;

affixing a security device to a securing member; and securing the securing member about the strap of the timepiece and a portion of the supporting member, wherein the timepiece is secured to the supporting member by the securing member.

* * * * *